United States Patent [19]

Trahan, Sr. et al.

[11] 4,273,466

[45] Jun. 16, 1981

[54] BASIN

[75] Inventors: Karl W. Trahan, Sr., Lafayette, La.; Timothy S. Smith, Eunice, La.

[73] Assignee: Kar Fabricators, Inc.

[21] Appl. No.: 43,264

[22] Filed: May 29, 1979

[51] Int. Cl.[3] ..... E01F 5/00

[52] U.S. Cl. ..... 404/4; 210/163

[58] Field of Search ..... 404/4, 5, 6; 52/19, 52/20; 210/163, 164

[56] References Cited

U.S. PATENT DOCUMENTS

| | | | |
|---|---|---|---|
| 1,457,637 | 6/1923 | Sievers | 210/163 X |
| 2,180,268 | 11/1939 | Ward | 210/164 |
| 2,445,197 | 7/1948 | Wiesmann | 404/3 X |
| 2,518,620 | 8/1950 | Hughes | 404/4 X |
| 2,938,437 | 5/1960 | Daley | 404/4 |
| 2,993,600 | 7/1961 | Ressler | 210/164 |
| 4,126,404 | 11/1978 | Ferns | 404/2 X |

FOREIGN PATENT DOCUMENTS

| | | | |
|---|---|---|---|
| 1301760 | 8/1969 | Fed. Rep. of Germany | 404/5 |
| 238412 | 8/1925 | United Kingdom | 404/5 |

*Primary Examiner*—Nile C. Byers, Jr.
*Attorney, Agent, or Firm*—Guy E. Matthews

[57] ABSTRACT

The present invention relates to a new and improved catch basin including a frame means mounted around an opening in drainage and/or sewer pipes, a riser means having an opening at each end thereof mounted with said frame, and a grid support means and grid means mounted therewith, said grid support means and grid means being positioned on the interior of said riser means and between each of said openings in said riser means for preventing undesirable, unwanted, oversized objects from entering into the drainage and/or sewer pipes.

2 Claims, 2 Drawing Figures fig.2
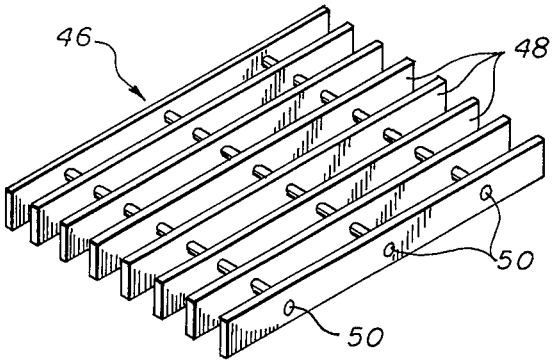
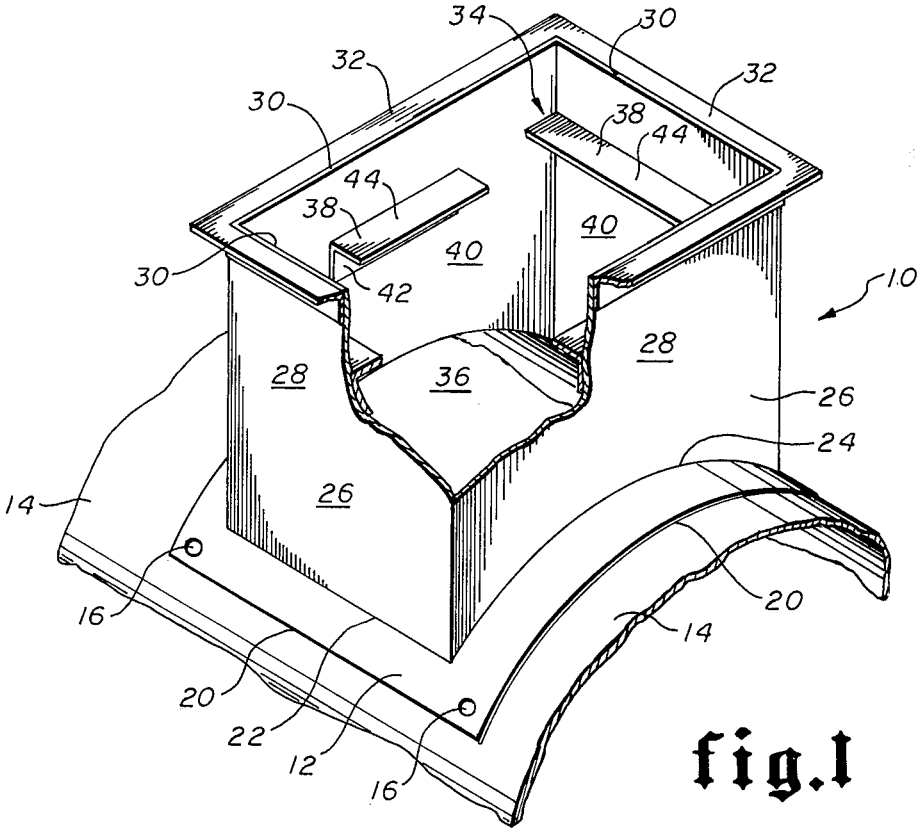
fig.1

BASIN

BACKGROUND OF THE INVENTION

This invention relates to a new and improved catch basin for mounting with drainage and/or sewage pipes along highways, streets, and in other areas as the need arises.

It is known that to prevent flooding along United States and state highways that means must be provided for enabling running water and other fluids to be quickly removed from drainage ditches and the like along highways to existing drainage and/or sewage systems. One way to collect water and fluids from such highways and drainage ditches associated therewith is the use of catch basins such as those set forth in U.S. Pat. Nos. 1,457,637; 2,180,268; 2,993,600; and 4,126,404.

As illustrated in such patents, such catch basins are normally constructed on site and are constructed of cement, concrete, or other materials for attaching to the drainage and/or sewage pipes. Obviously, such construction is expensive and time consuming. Such catch basins do not normally for any period of time due to wear and tear on the aggregate of which such catch basins are formed.

BRIEF SUMMARY OF THE INVENTION

It is an object of the present invention to provide a new and improved catch basin which is preformed off the location or site of use of the catch basin and is of a durable material to eliminate wear and tear thereof.

Yet another object of the present invention is to provide a new and improved catch basin.

BRIEF DESCRIPTION OF THE DRAWINGS

FIG. 1 is a perspective view of the catch basin of the present invention;

FIG. 2 is a perspective view of a grid means of the present invention for placing in the catch basin.

DESCRIPTION OF THE PREFERRED EMBODIMENTS

As illustrated in FIG. 1, the catch basin of the present invention is generally illustrated by the numeral 10 and includes frame means 12 for securely mounting with concrete or similar pipe members 14 by placing bolts or other suitable fasteners (not shown) through openings 16. As illustrated in FIG. 1, frame means 12 has a bottom surface 18 which is concave in shape such that frame means 12 conforms to the exterior surface or shape of sewage or drainage means 14. Frame means 12 is generally rectangular in shape and includes edges 20 which extend inwardly to base edges 22 formed the junction of frame means 12 and the lower base 24 of riser means 26.

It is to be understood that frame means 12 and riser means 26 have an opening therein (not shown) which communicates with an opening (not shown) in the drainage or sewer pipe 14 such that the frame means 12 and base 24 of riser means 26 are mounted over the opening in the drainage or sewage pipe 14.

Riser means 16 extends outwardly from such frame means 12 and is defined by side walls 28 which end at edge 30 and upper frame 32 defines the upper opening 34 in the riser means 26 which communicates with the lower opening in the riser means 26 and through the drain pipe 14 to form a hollow rectangular opening 36 extending the length of the riser means 26.

A plurality of grid support members 38 is mounted on each of the interior walls 40 of riser means 26 and is generally in the shape of an attaching arm 42 mounted with the interior walls 40 and a support arm 44 extending outwardly therefrom through the rectangular opening 36.

As illustrated in FIG. 2, a grid means is generally designated at 46 which includes a plurality of spaced parallel rigid bar members 48 and a plurality of stabilizer rods 50 extending transversely through each of said members 48 to form such grid means 46.

In operation, the catch basin 10 of the present invention is preformed off the site of its installation. The frame means 12 is mounted around the opening in the drainage pipe 14 and secured thereto by any suitable manner such as bolts mounted through the openings 16. The grid or grading means 46 is then placed through the opening 34 of the riser means 26 and into the longitudinal hollow section 36 of the riser means 26 such that each of the spaced parallel rigid bars 48 is supported by the support arms 44 mounted to the attachment arm 42 which is securely fastened to the interior wall of the riser means 26.

When flooding occurs or when the top opening 34 receives fluids, the fluids pass through the grid or grate means 46 and into the opening of the drain pipe 14 for removal of such fluids. If undesirable trash or unwanted objects are carried by the fluids into the opening 34, they are prevented from entering into the drain pipe 14 by the grid network 46 retaining such on top of the grid 46.

It is to be further understood that catch basin 10 of the present invention is normally installed along highways or in the bottom of drainage ditches and the like to extend upwardly from such drainage and/or sewage ditches such that the sewage ditches or pipes 14 along the highways or in the ditches can be covered and that only the opening 34 of the catch basin 10 is exposed.

It is also to be understood that the best mode of the invention has been described, but several other modes of the invention may occur and that other modes and species of the invention are covered by and included in the scope of the claims appended hereto.

What is claimed is:

1. A preformed catch basin for mounting with a drainage pipe for catching fluids including running rain water, streams, and the like to prevent flooding, comprising:

(a) frame means for mounting around the opening in the drainage pipe to enable mounting of said catch basin around the opening;

(b) riser means extending from said frame means, said riser means having an opening therein communicating with the opening in the drainage pipe and opening at its other end for receiving fluids;

(c) grid support means attached around the interior periphery of said riser means and positioned between the opening of said frame means communicating with the opening in the drainage pipe and the opening at the other end of said frame means; and (d) grid means positioned for preventing oversized and unwanted debris and trash entering into the drainage pipe wherein said catch basin enables fluids to enter said opening of said riser means and flow through said grid means, through said opening of said riser means communicating with the opening of said drainage pipe to deposit fluids in said drainage pipe while said grid means prevents oversized articles and/or trash from being deposited in said drain and/or sewer pipes.

2. The structure as set forth in claim 1 wherein said grid means includes a plurality of spaced rigid parallel bars and a plurality of stabilizer rods mounted transversely to and with each of said plurality of rods to form a rigid grid for preventing objects from entering into the drainage pipe.

* * * * *